US008016292B1

(12) United States Patent
Yang et al.

(10) Patent No.: US 8,016,292 B1
(45) Date of Patent: Sep. 13, 2011

(54) GAME MACHINE

(75) Inventors: I-Chiang Yang, Changhua County (TW); Tsair-Rong Chen, Changhua County (TW); Wen-Ren Yang, Taichung (TW)

(73) Assignee: Feiloli Electronic Co., Ltd., Hemei Town, Changhua County (TW)

( * ) Notice: Subject to any disclaimer, the term of this patent is extended or adjusted under 35 U.S.C. 154(b) by 0 days.

(21) Appl. No.: 12/891,728

(22) Filed: Sep. 27, 2010

(51) Int. Cl.
*A63F 9/00* (2006.01)

(52) U.S. Cl. ..... 273/451; 273/447; 273/459; 273/460

(58) Field of Classification Search ..... 273/440, 273/447, 448, 451, 454, 459, 460
See application file for complete search history.

(56) References Cited

U.S. PATENT DOCUMENTS 7,600,760 B2 * 10/2009 Matsuda et al. ..... 273/447
7,841,599 B2 * 11/2010 Todokoro ..... 273/447
7,934,723 B2 * 5/2011 Sasaki et al. ..... 273/138.3
2008/0088092 A1 * 4/2008 Todokoro ..... 273/447
2008/0242413 A1 * 10/2008 Matsuda ..... 463/38

FOREIGN PATENT DOCUMENTS

JP 2001212362 A * 8/2001
JP 2002172269 A * 6/2002
JP 2003154156 A * 5/2003
JP 2008054796 A * 3/2008

* cited by examiner

*Primary Examiner* — Raleigh W. Chiu

(57) ABSTRACT

A game machine includes a main frame standing on a supporting surface, a move assembly and a rack respectively disposed in the main frame. An operating unit and a slot unit are respectively disposed on the main frame. A prize dispensing hole is defined in the main frame. The moving assembly includes an X-axis drive unit, a Y-axis drive unit and a Z-axis push unit. The rack has multiple rooms defined therein and each room has a prize received therein. The player can control the X-axis drive unit and the Y-axis drive unit to make the Z-axis push unit linearly corresponding to one of the rooms for pushing the prize in the corresponding room such that the pushed prize falls into the prize dispensing hole and the player can take the fallen prize from the prize dispensing hole.

14 Claims, 8 Drawing Sheets

GAME MACHINE

BACKGROUND OF THE INVENTION

1. Field of the Invention

The present invention relates to a game machine, and more particularly to a game machine that has three axis operating units for pushing a prize that is received in the game machine.

2. Description of Related Art

A conventional cabinet-type game machine, such as a doll catch machine, is popular in an amusement park. The doll catch machine, for example, has a catcher that is firstly moved along X-axis and the Y-axis above the dolls. Secondly, the catcher is moved along Z-axis to catch the aligned doll. Lastly, the caught doll is fallen into a passage and the player can get the doll as a reward from the passage.

However, the suspensory game machine has been popular for a long time and becomes bored to the consumers. The types of dolls are often changed, but few consumers want to try again. Consequently, the play ways of the suspensory game machine need to be advantageously altered.

The present invention has arisen to mitigate and/or obviate the disadvantages of the conventional suspensory game machine.

SUMMARY OF THE INVENTION

The main objective of the present invention is to provide an improved game machine that has three axis operating units for pushing a prize that is received in the game machine.

To achieve the objective, the game machine in accordance with the present invention comprises a main frame having a partition horizontally disposed therein such that an operating space defined in an upper portion of the main frame. A drop-in port is defined in the partition. A prize dispensing hole is defined in the main frame and communicates with the drop-in port for player to take a fallen prize from the game machine. A move assembly is disposed in the main frame and includes a frame perpendicularly mounted on the partition. The frame has an upper side and a lower side. An X-axis drive unit is arranged within the frame. The X-axis drive unit has four X-axis rods, wherein two parallel X-axis rods correspond to the upper side of the frame and the other parallel two correspond to the lower side of the frame. An upper slider is slidably mounted on the two X-axis rods that correspond to the upper side of the frame and a lower slider slidably mounted on the two X-axis rods that correspond to the lower side of the frame, wherein the upper slider and the lower slider are synchronously moved in a same direction when the X-axis drive unit is operated. A Y-axis drive unit is mounted on the lower slider and has two parallel Y-axis rods each having two opposite ends respectively connected to the upper slider and the lower slider. A Y-axis slider is slidably mounted on the two Y-axis rods and connected to the Y-axis drive unit such that the Y-axis slider is reciprocally moved relative to the two Y-axis rods when the Y-axis drive unit is operated. A Z-axis push unit is mounted on the Y-axis slider. The Z-axis push unit has a reciprocal moving structure for pushing a prize in the game machine. A rack stands on the partition front of the drop-in port and has a series of rooms defined therein and horizontally extending therethrough. Each room has a prize received therein. An operating unit is mounted on a front portion of the main frame. The operating unit is electrically connected to the X-axis drive unit, the Y-axis drive unit and the Z-axis push unit for player to easily control the move assembly.

The player can control the X-axis drive unit and the Y-axis drive unit to make the Z-axis push unit linearly corresponding to one of the rooms for pushing the prize in the corresponding room such that the pushed prize falls into the prize dispensing hole through the drop-in port and the player can take the fallen prize from the prize dispensing hole.

Further benefits and advantages of the present invention will become apparent after a careful reading of the detailed description with appropriate reference to the accompanying drawings.

DETAILED DESCRIPTION OF THE INVENTION

Figure 1:
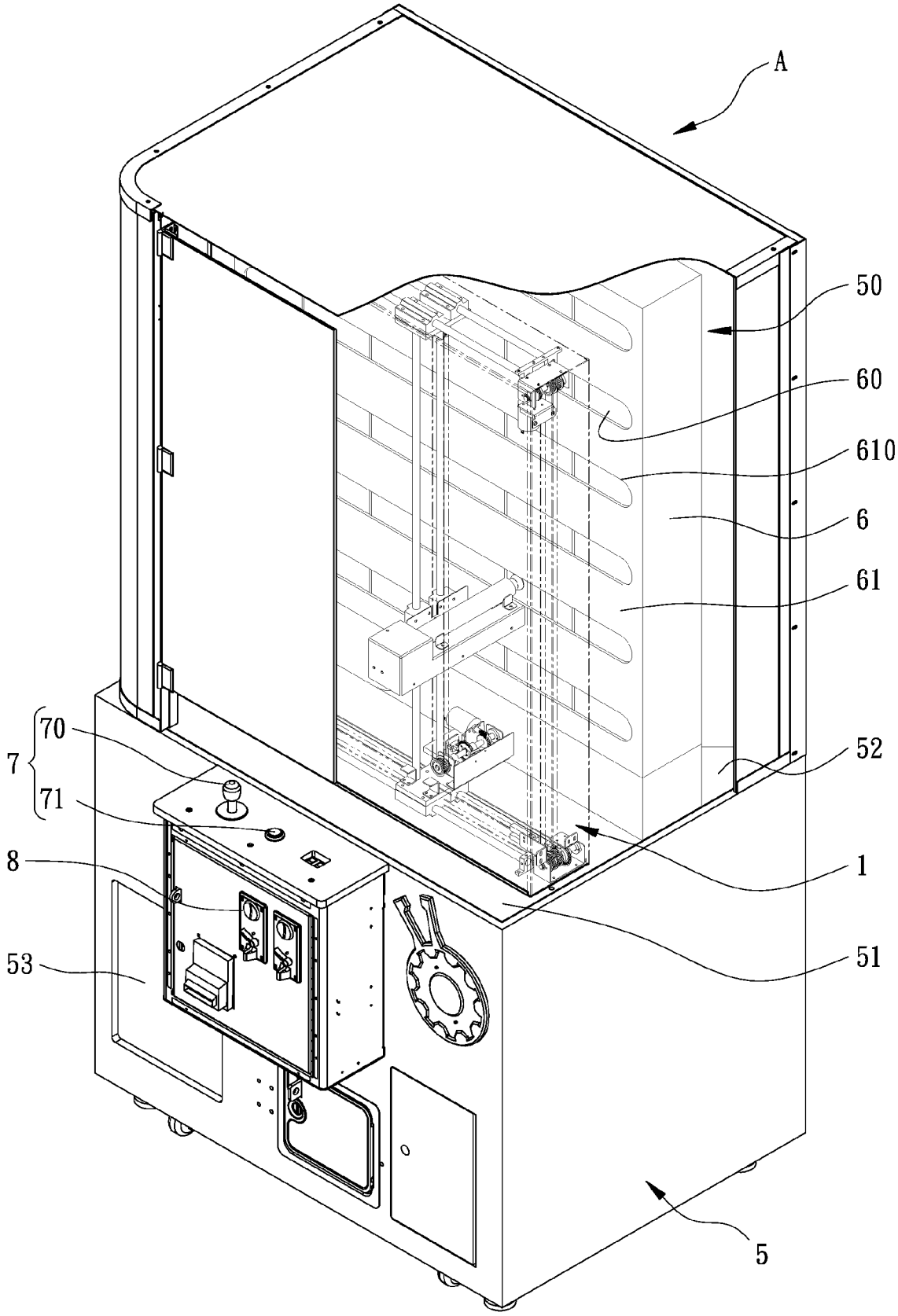
FIG. 1 is a perspective view of a game machine in accordance with the present invention.

Referring to the drawings and initially to FIG. 1, a game machine (A) in accordance with the present invention comprise a main frame (5) standing on a supporting surface, a move assembly (1) and a rack (6) respectively disposed in the main frame (5). An operating unit (7) and a slot unit (8) are respectively disposed on the main frame (5).

The main frame (5) is has a cabinet-like structure and a partition (51) is horizontally mounted in the main frame (5) such that an operating space (50) is defined in an upper portion of the main frame (5). A drop-in port (52) is defined in a rear portion of the partition (51). A prize dispensing hole (53) is defined in the main frame (5) and communicates with the drop-in port (52) for player to take the fallen prize (9).

Figure 2:
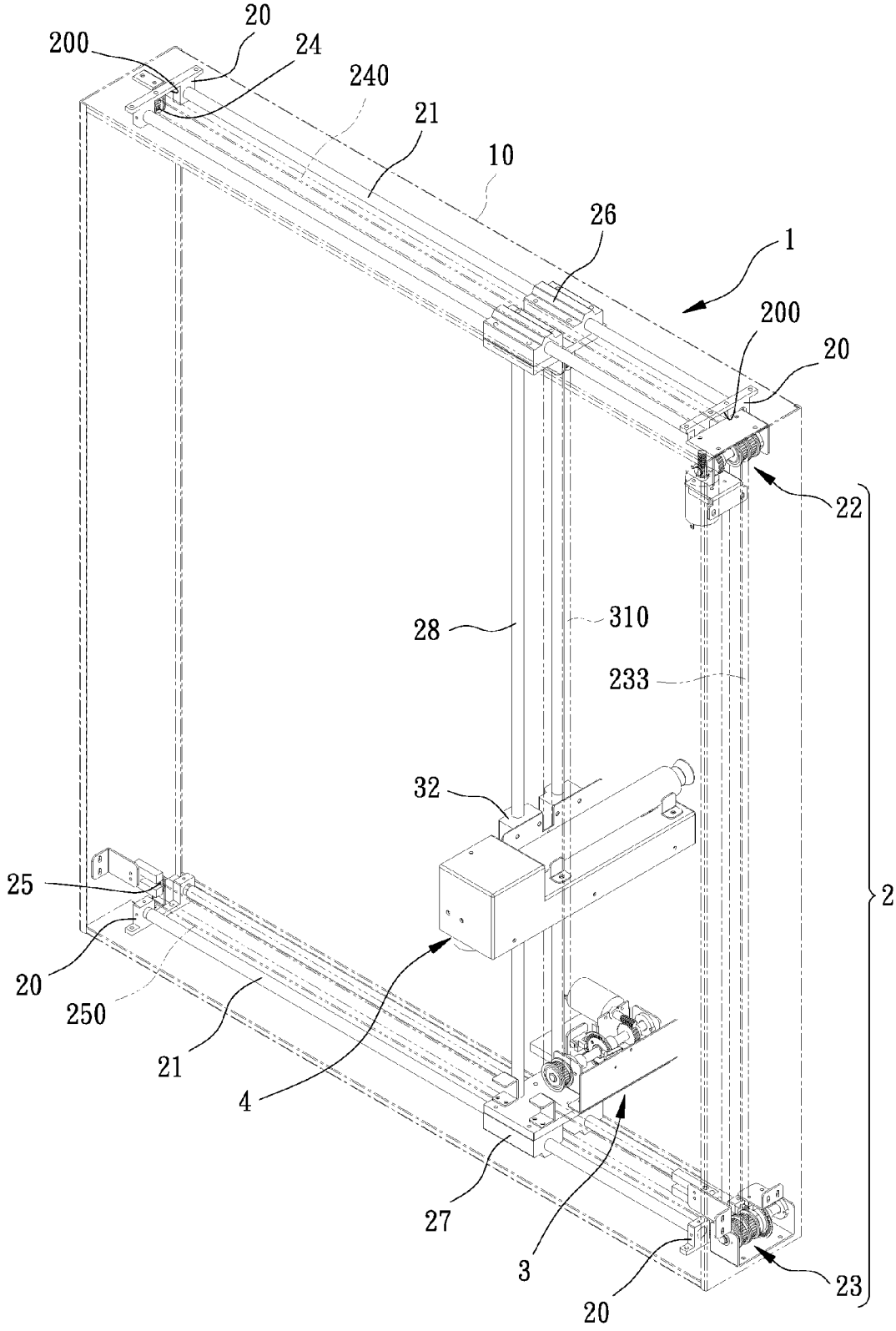
FIG. 2 is a perspective view of a move assembly of the game machine in FIG. 1.

With reference to FIGS. 1 and 2, a frame (10) is perpendicularly mounted on the partition (51) and the move assembly (1) is arranged within the frame (10). The move assembly (1) comprises an X-axis drive unit (2), a Y-axis drive unit (3) and a Z-axis drive unit (4) respectively described, hereinafter.

Figure 3:
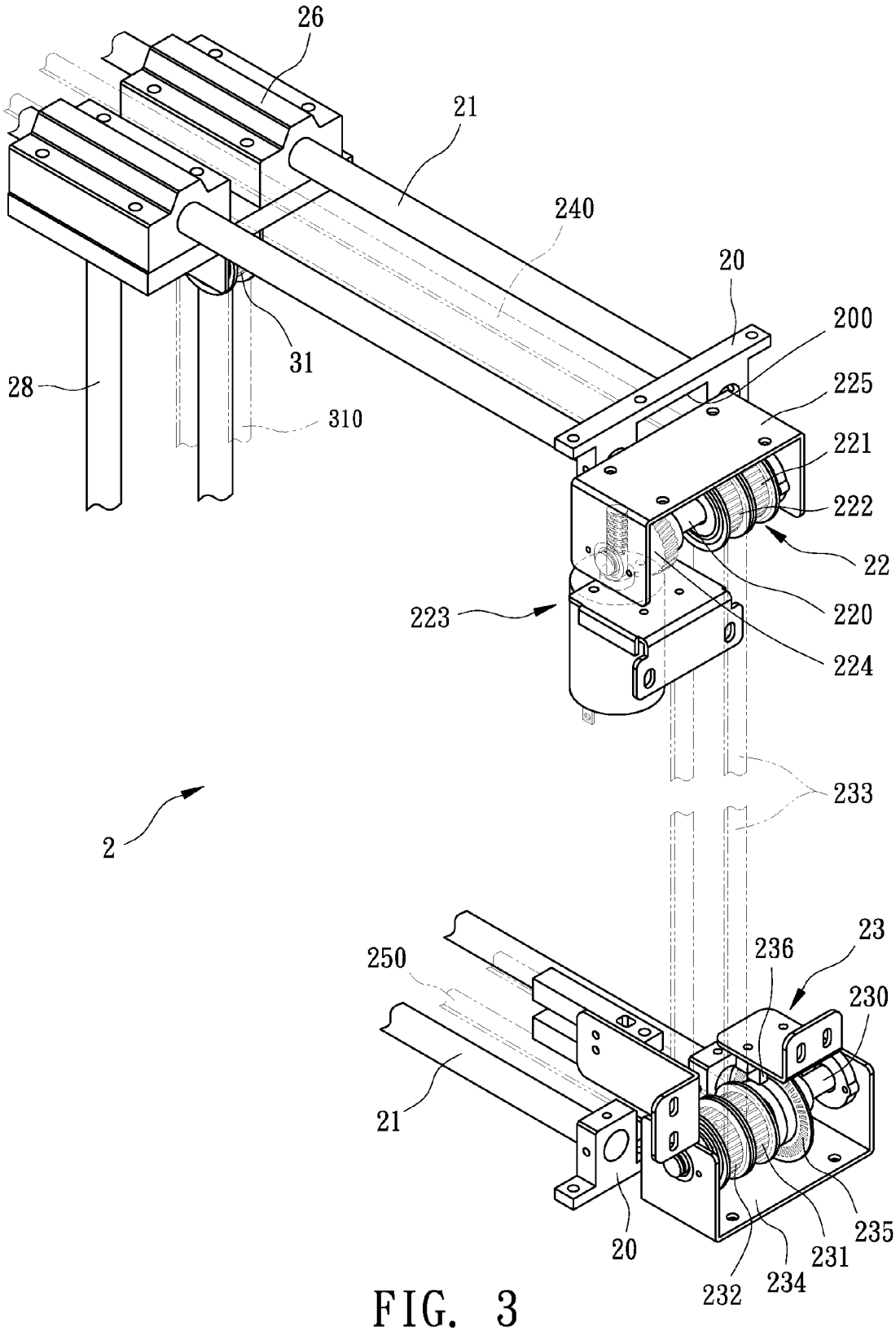
FIG. 3 is a perspective view of an X-axis drive unit of the move assembly in FIG. 2.
Figure 4:
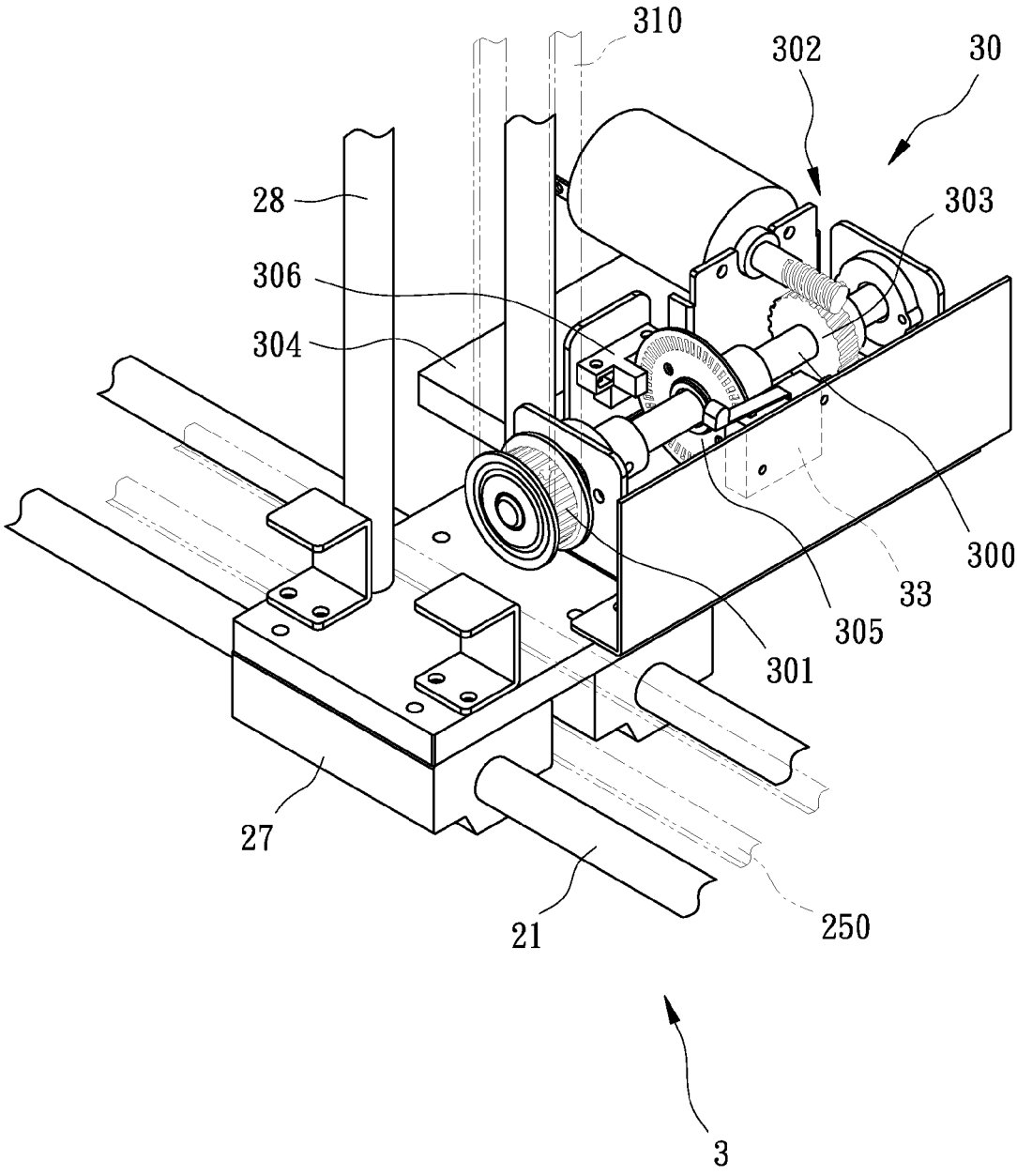
FIG. 4 is a perspective view of a Y-axis drive unit of the move assembly in FIG. 2.

With reference to FIG. 3, the X-axis drive unit (2) has four seats (20), wherein the frame (10) has a lower side and an upper side each has two seats (20) respectively mounted to two opposite ends of each of the lower side and the upper side of the frame. Two parallel X-axis rods (21) are mounted between two seats (20) that horizontally correspond to each other. Each seat (20) has a groove (200) defined therein between the two parallel X-axis rods (21). A drive gear set (22) is laterally mounted to one of the two seats (20) that are mounted on the upper side of the frame (10) and a driven gear set (23) is mounted to one of the two seats (20) that are mounted on the lower side of the frame (10), wherein the drive gear set (22) and the driven gear set (23) are located at one lateral side of the frame (10). A first belt pulley (24) and a second belt pulley (25) are respectively mounted on a corresponding one of the four seats (20) of the Z-axis drive unit (2), wherein the first belt pulley (24) and the second belt pulley (25) respectively horizontally correspond to the drive gear set (22) and the driven gear set (23). An upper slider (26) is slidably mounted on the two X-axis rods (21) that correspond to the upper side of the frame (10) and a lower slider (27) is slidably mounted on the two X-axis rods (21) that correspond to the lower side of the frame (10). Two parallel Y-axis rods (28) are connected to the upper slider (26) and the lower slider (27), in the preferred embodiment of the present invention, the two Y-axis rods (28) is perpendicular relative to the partition (51).

The drive gear set (22) of the X-axis drive unit (2) includes a bracket (225) secured on the inner periphery of the upper side of the frame (10) and a first shaft (220) is rotatably mounted within the bracket (225). A third belt pulley (221) and a fourth belt pulley (222) respectively securely sleeved on the first shaft (220). The drive gear set (22) of the A-axis drive unit (2) includes a drive set (223) mounted on the bracket (225) for reciprocally driving the first shaft (220) and having a worm wheel (224) secured on one end of the first shaft (220). An endless first belt (240) winds around the first belt pulley (241) and the third belt pulley (221). The first belt (240) passes through the groove (200) and has a connecting portion (not numbered) secured on the upper slider (26).

The driven gear set (23) of the X-axis drive unit (2) includes a bracket (234) secured on an inner periphery of the lower side of the frame (10) and a second shaft (230) is rotatably mounted within the bracket (234) of the driven gear set (23). A fifth belt pulley (231) and a sixth belt pulley (232) are securely sleeved on the second shaft (230). An endless second belt (250) extends through a groove (200) of a corresponding one of the seats (20) and winds around the second belt pulley (25) and the fifth belt pulley (231). The second belt (250) has a connecting portion (not numbered) secured on the lower slider (27). An endless third belt (233) winds around the fourth belt pulley (222) and the sixth belt pulley (232).

The drive set (23) of the X-axis drive unit (2) is provided to drive the first shaft (220) such that the third belt pulley (221) and the fourth belt pulley (222) is rotated to respectively drive the first belt pulley (24) and the sixth belt pulley (232) via the first belt (240) and the third belt (233). As a result, the second shaft (230) and the fifth belt pulley (231) are rotated with the sixth belt pulley (232) to drive the second belt (250) such that the upper slider (26) and the lower slider (27) are synchronously moved along a same direction (X-axis) due to the operated first belt (240) and the second belt (250).

With reference to FIGS. 1-4, the Y-axis drive unit (3) includes a drive gear set (30) having a bracket (304) mounted on the lower slider (27) of the X-axis drive unit (2) and a third shaft (300) rotatably mounted on the bracket (304). A seventh belt pulley (301) is securely sleeved on a first end of the third shaft (300) and a worm wheel (303) is securely sleeved on a second end of the third shaft (300). The drive gear set (30) of the Y-axis drive unit (3) has a drive set (302) mounted on the bracket (304) for reciprocally driving the worm wheel (303) with the third shaft (300). An eighth belt pulley (31) is rotatably mounted onto an underside of the upper slider (26) and a Y-axis slider (32) is slidably mounted on the two Y-axis rods (28). An endless fourth belt (310) winds around the seventh belt pulley (301) and the eighth belt pulley (31), and has a connecting portion (not numbered) secured on the Y-axis slider (32).

The Y-axis slider (32) is moved along the two Y-axis rods (28) when the third shaft (300) with the worm wheel (303) is driven by the drive set (302) and the fourth belt (310) is operated.

A limit sensor (33) is mounted to a upper portion of the drive gear set (30) of the Y-axis drive unit (3) and electrically connected to the drive set (302) of the drive gear set (30) of the Y-axis drive unit (3). In the preferred embodiment of the present invention, the limit sensor (33) is a sensitive switch. The limit sensor (33) transmits a signal to cut off the power supply of the of the drive set (302) to prevent the Y-axis slider (32) from crashing the drive gear set (30) of the Y-axis drive unit (3) when the limit sensor (33) senses the underside of the Y-axis slider (32).

Figure 5:
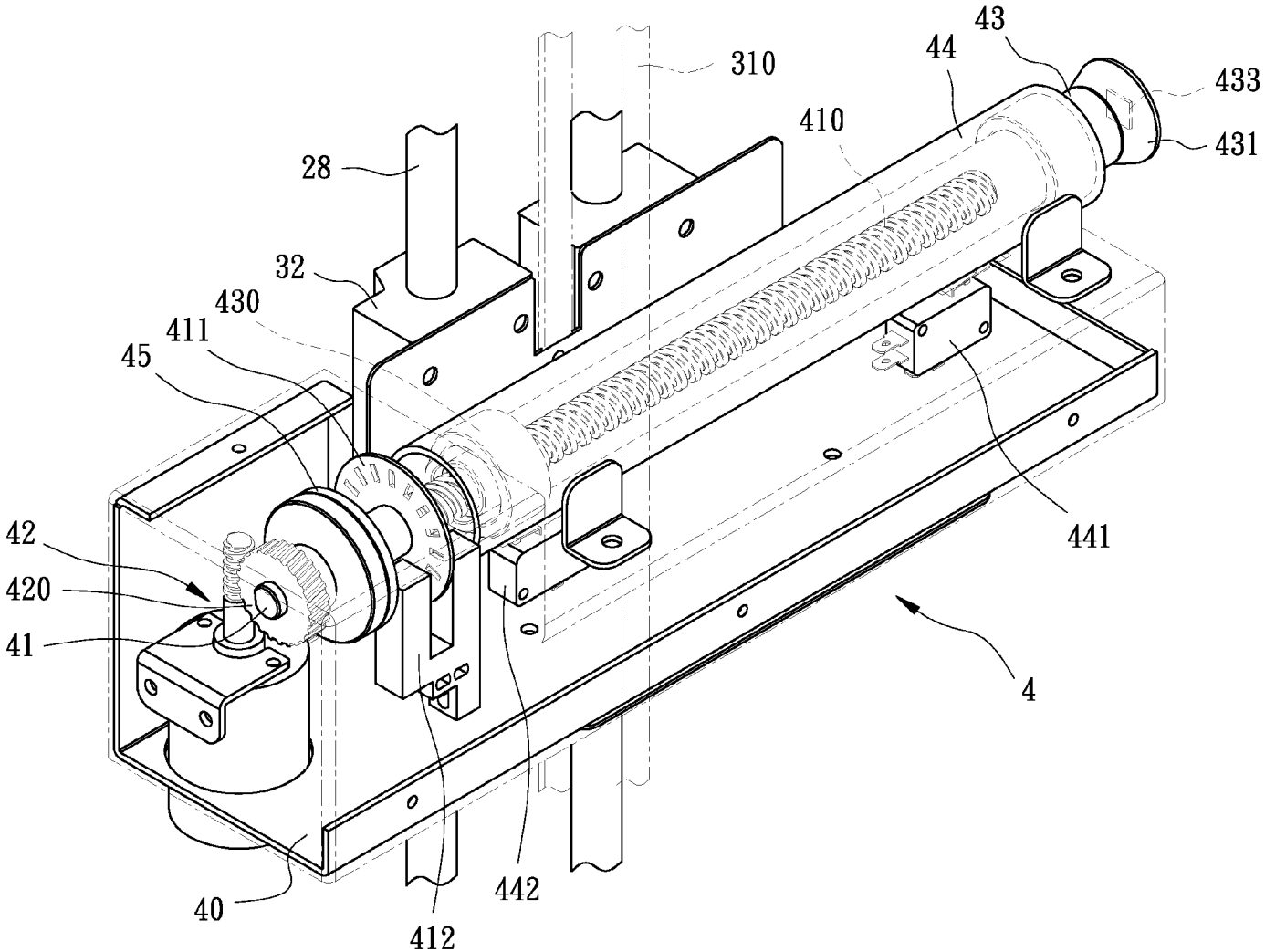
FIG. 5 is a front perspective view of a Z-axis drive unit of the move assembly in FIG. 2.
Figure 6:
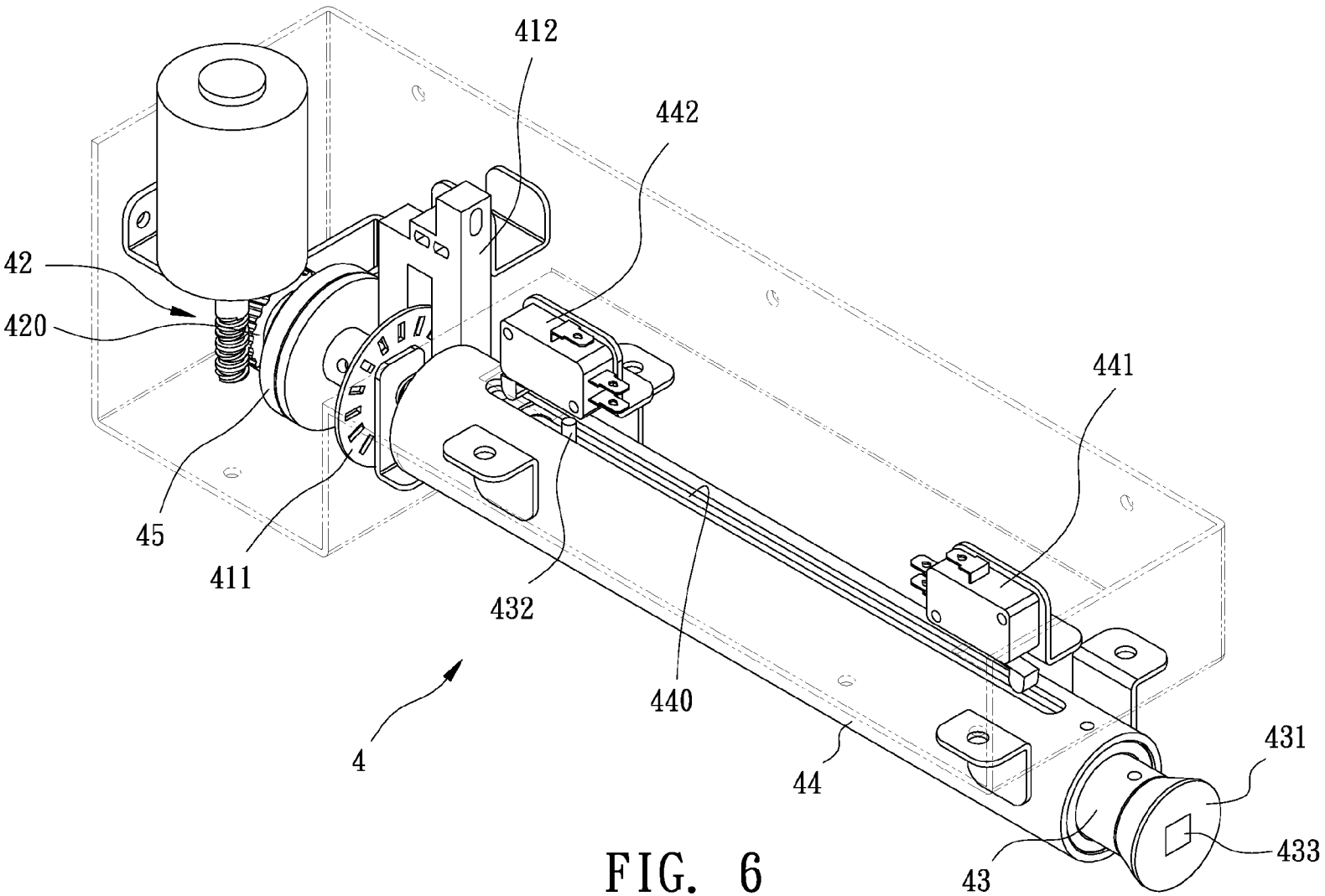
FIG. 6 is a rear perspective view of the Z-axis drive unit of the move assembly in FIG. 2.
Figure 7:
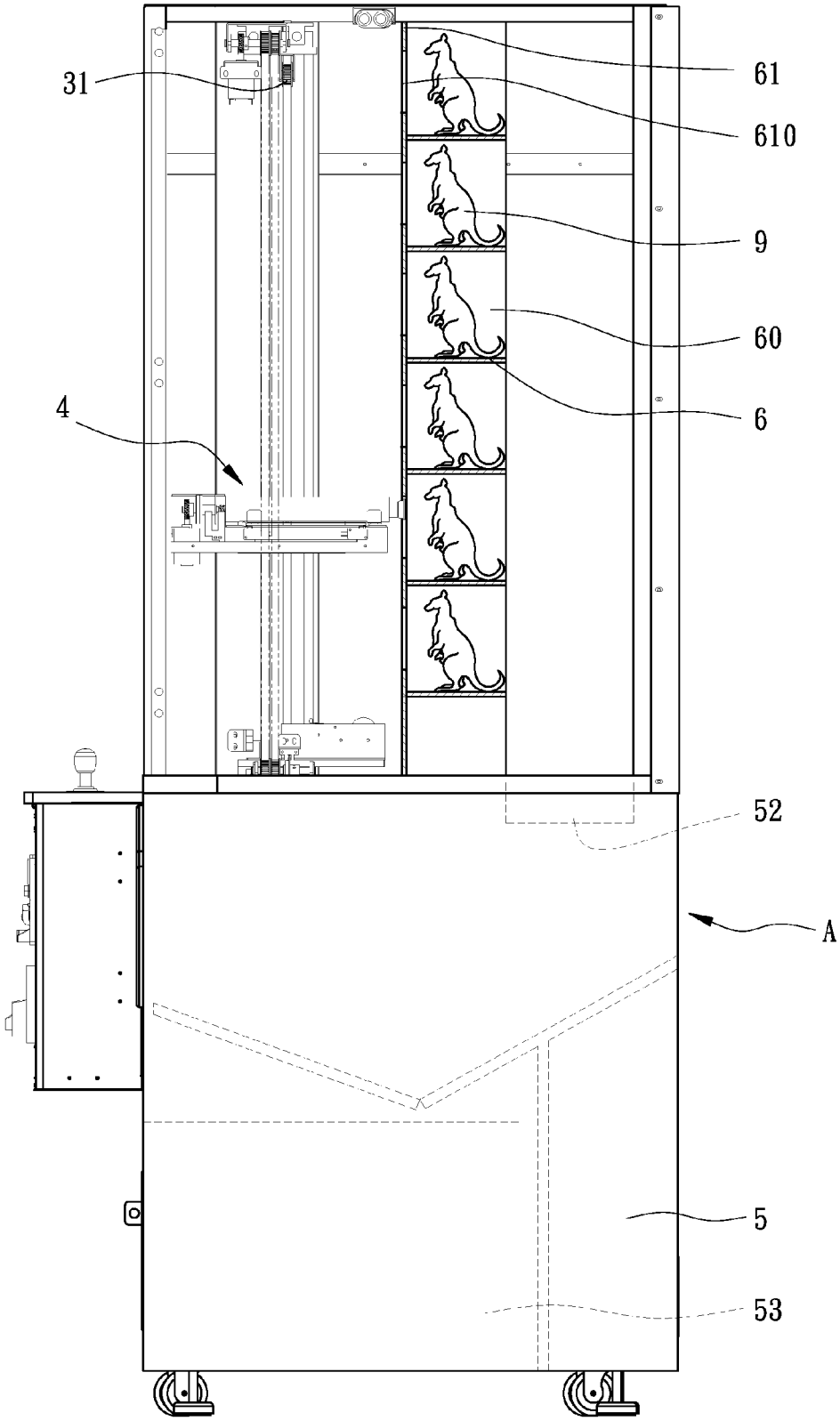
FIG. 7 is a side cross-sectional view of the game machine in accordance with the present invention when the Z-axis drive unit is in an original position.
Figure 8:
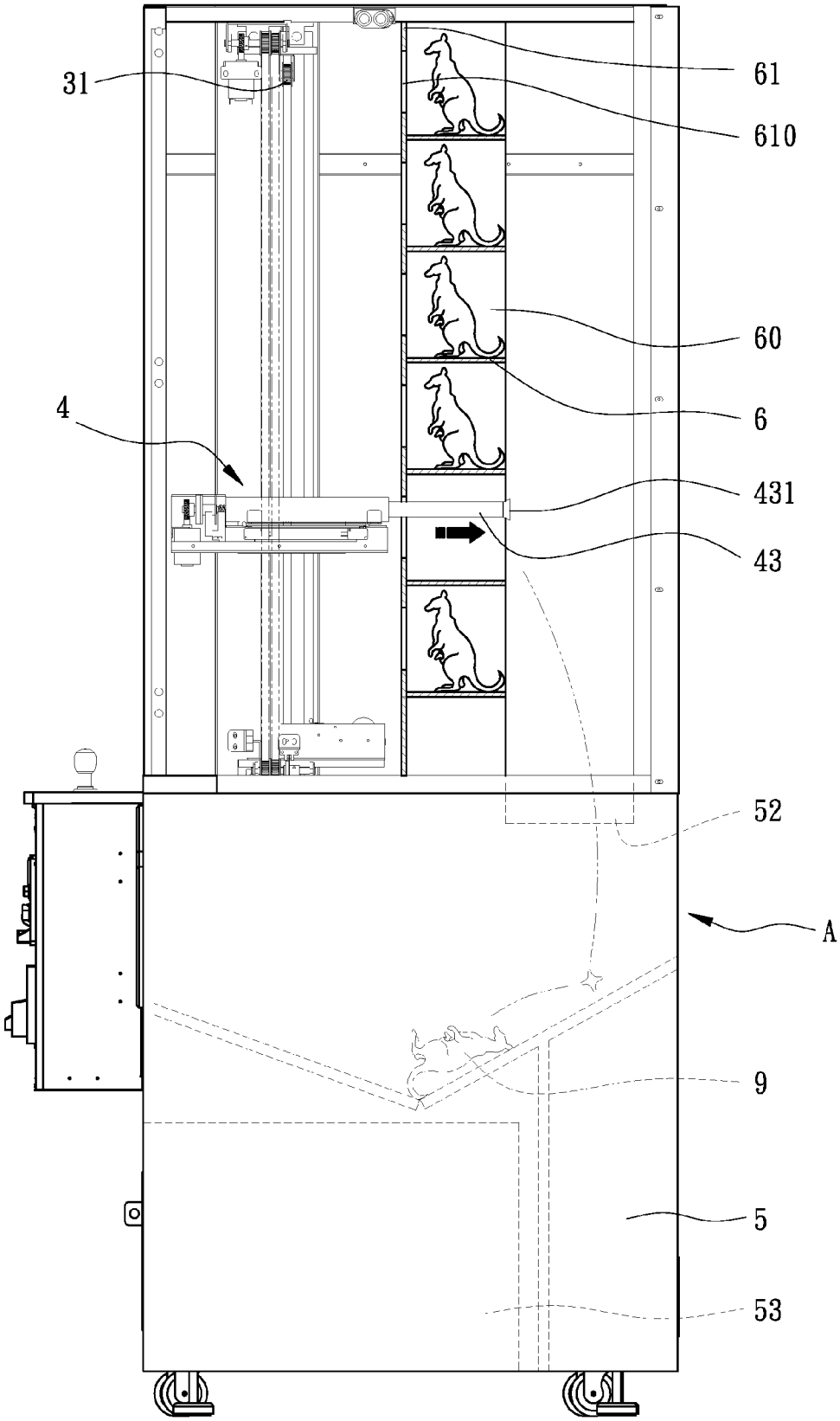
FIG. 8 is a side cross-sectional view of the game machine in accordance with the present invention when the Z-axis drive unit is operated to pushing prize.

Further with reference to FIGS. 5 and 6, the Z-axis push unit (4) includes a bracket (40) laterally mounted to the Y-axis slider (32). A fourth shaft (41) is rotatably mounted on the bracket (40) of the Z-axis push unit (4) and a drive set (42) is mounted on the bracket (40) of the Z-axis push unit (4) for reciprocally driving the fourth shaft (41). The drive set (42) of the Z-axis push unit (4) has a worm wheel (420) securely sleeved on a first end of the fourth shaft (41). A threaded rod (410) is co-axially connected to a second end of the fourth shaft (41) via a magnetic reluctance clutch (45). An inner tube (43) is stably put around the threaded rod (410) and the inner tube (43) is reciprocally moved relative to the threaded rod (410) when the threaded rod (410) is rotated. An outer tube (44) is put around the inner tube (43) and secured on the bracket (40) of the Z-axis push unit (4), wherein the inner tube (43) is movably received in the outer tube (44).

A threaded sleeve (430) is co-axially and securely mounted to a rear end of the inner tube (43), movably received in the outer tube (44) and screwed onto the threaded rod (410). A head (431) is secured on a front end of the inner tube (43) and a pressure sensor (433) is mounted in the head (431), wherein the pressure sensor (433) is electrically connected to the drive set (42) of the Z-axis push unit (4). A longitudinal groove (440) is defined in the outer tube (44). A stub (432) outwardly and radially extends from the inner tube (43). The stub (432) extends through the longitudinal groove (440) and the longitudinal groove (440) has a width slightly greater than a diameter of the stub (432) such that the inner tube (43) is not rotatable relative to the outer tube (44). A front limit sensor (441) and a second limit sensor (442) are respectively secured on two opposite ends of the outer tube (44) and respectively correspond to two opposite ends of the longitudinal groove (440). The front limit sensor (441) and the rear limit sensor (442) are respectively electrically connected to the drive set (42) of the Z-axis push unit (4). In the preferred embodiment of the present invention, the front limit sensor (441) and the rear limit sensor (442) are sensitive switch. The inner tube (43) is reciprocally longitudinally moved relative to the threaded rod (410) and the outer tube (44) when the drive set (42) of the Z-axis push unit (4) drives the fourth shaft (41) to make the threaded rod (410) be rotated relative to the threaded sleeve (430). The power of the drive set (42) of the Z-axis push unit (4) is temporarily cut off and immediately restored, then the drive set (42) of the Z-axis push unit (4) start to reversely drive the fourth shaft (41) when the stub (432) contracts with the front limit sensor (441). The power of the drive set (42) of the Z-axis push unit (4) is cut off for next operation when the stub (432) contracts with the rear limit sensor (442).

The rack (6) stands on the partition (51) front of the drop-in port (52) and has series of rooms (60) defined therein and horizontally extending therethrough. Each room (60) is provided to receive a prize (9). A panel (61) is mounted to a front face for closing the rooms (60). Multiple openings (610) is defined in the panel (61) and each opening (610) communicates with a corresponding one of the series of rooms (60).

The operating unit (7) is mounted on a front portion of the main frame (5) and electrically connected to the X-axis drive unit (2), the Y-axis drive unit (3) and the Z-axis push unit (4) for player to easily control the X-axis drive unit (2), the Y-axis drive unit (3) and the Z-axis push unit (4). The operating unit (7) has a rocker (71) for controlling the X-axis drive unit (2) and the Y-axis drive unit (3), and a button (71) for controlling the Z-axis push unit (4).

A slot unit (8) is disposed on the main frame (5) and electrically connected to the operating unit (7), the X-axis drive unit (2), the Y-axis drive unit (3) and the Z-axis push unit (4) for player to input token, coin or bill.

With reference to FIGS. 1-8, each room (60) in the rack (6) has a prize (9) received therein and the received prize (9) is aligned with the corresponding opening (610). The operating unit (7) is ready for operation after the player inserting token, coin or bill into the slot unit (8). The player can control and operate the X-axis drive unit (2) and the Y-axis drive unit (3) of the move assembly (1) via the rocker (70) to make the head (431) of the Z-axis push unit (4) linearly corresponding to one of the openings (610).

The player can press the button (71) to make the inner tube (43) with the head (431) moved toward the prize (9). The inner tube (43) with the head (431) extends into the corresponding room (60) via the opening (610) for pushing the prize (9) and making the prize (9) fall into the prize dispensing hole (53) via the drop-in port (52) when the inner tube (43) is linearly aligned with the corresponding opening (610). Consequently, the player can take the fallen prize (9) form the prize dispensing hole (53). The power of the drive set (42) of the Z-axis push unit (4) is temporarily cut off and the drive set (42) of the Z-axis push unit (4) immediately reversely drives the threaded rod (410) to make the inner tube (43) moved to its original position when the front limit sensor (441) sensing the stub (432). The move assembly (1) is completely ceased and waits for next operation when the rear limit sensor sensing the stub (432).

The head (431) strike the panel (61) and the pressure sensor (433) senses a reacting force from the panel (61) when the inner tube (43) does not fully align with the opening (610) when the button (71) is pressed. The pressure sensor (433) touches off the magnetic reluctance clutch (45). The threaded rod (410) is idled relative the fourth shaft (41) to stop extending inner tube (43) when the reacting force from the head (431) is greater than the interior magnetic force of the magnetic reluctance clutch (45). At the same time, the drive set (42) of the Z-axis push unit (4) immediately reversely drives the threaded rod (410) to make the inner tube (43) moved to its original position and the move assembly (1) is completely ceased and waits for next operation when the rear limit sensor sensing the stub (432).

For stably control the move speed of the X-axis drive unit (2), the Y-axis drive unit (3) and the Z-axis push unit (4), three optical grating plates (235, 305, 411) are respectively concentrically mounted to the second shaft (230), the third shaft (300) and the fourth shaft (41). In addition, three optical interceptors (236, 306, 412) are respectively and sequentially secured on the brackets (234, 304, 40) and respectively sequentially correspond to the three optical grating plates (235, 305, 411). The light ray from the optical interceptors (236, 306, 412) forms a series of continual square wave signals for controlling the output rate of the drive sets (223, 302, 42) after passing through the corresponding optical grating plates (235, 305, 411) and occurring an optical coupling action.

Although the invention has been explained in relation to its preferred embodiment, it is to be understood that many other possible modifications and variations can be made without departing from the spirit and scope of the invention as hereinafter claimed.

What is claimed is:

1. A game machine comprising:

a main frame having a partition horizontally disposed therein such that a operating space defined in an upper portion of the main frame, a drop-in port defined in the partition, a prize dispensing hole defined in the main frame and communicating with the drop-in port for player to take a fallen prize from the game machine;

a move assembly disposed in the main frame and including:

a frame perpendicularly mounted on the partition, the frame having an upper side and a lower side;

an X-axis drive unit arranged within the frame, the X-axis drive unit having four X-axis rods, wherein two parallel X-axis rods correspond to the upper side of the frame and the other parallel two correspond to the lower side of the frame, an upper slider slidably mounted on the two X-axis rods that correspond to the upper side of the frame and a lower slider slidably mounted on the two X-axis rods that correspond to the lower side of the frame, wherein the upper slider and the lower slider are synchronously moved in a same direction when the X-axis drive unit is operated;

a Y-axis drive unit mounted on the lower slider and having two parallel Y-axis rods each having two opposite ends respectively connected to the upper slider and the lower slider, a Y-axis slider slidably mounted on the two Y-axis rods and connected to the Y-axis drive unit such that the Y-axis slider is reciprocally moved relative to the two Y-axis rods when the Y-axis drive unit is operated; and a Z-axis push unit mounted on the Y-axis slider, the Z-axis push unit having a reciprocal moving structure for pushing a prize in the game machine;

a rack standing on the partition front of the drop-in port and having series of rooms defined therein and horizontally extending therethrough, each room having a prize received therein; and an operating unit mounted on a front portion of the main frame, the operating unit electrically connected to the X-axis drive unit, the Y-axis drive unit and the Z-axis push unit for player to easily control the move assembly, whereby the player can control the X-axis drive unit and the Y-axis drive unit to make the Z-axis push unit linearly corresponding to one of the rooms for pushing the prize in the corresponding room such that the pushed prize falls into the prize dispensing hole through the drop-in port and the player can take the fallen prize from the prize dispensing hole.

2. The game machine as claimed in claim 1, wherein:

the X-axis rods, which correspond to the upper side of the frame, includes a first end having a drive gear set mounted thereon and a second end having a first belt pulley rotatably mounted thereon, a first belt winding around the drive gear set and the first belt pulley, wherein the first belt has a connecting portion secured on the upper slider; and the X-axis rods, which correspond to the lower side of the frame, includes a first end having driven gear set mounted thereon and a second end having a second belt pulley rotatably mounted thereon, a second belt winding around the driven gear set and the second belt pulley, wherein the second belt has a connecting portion secured on the lower slider.

3. The game machine as claimed in claim 2, wherein the drive gear set of the X-axis drive unit comprises a bracket secured on an inner periphery of the upper side of the frame and a first a first shaft rotatably mounted within the bracket, a third belt pulley and a fourth belt pulley respectively securely sleeved on the first shaft, a drive set mounted on the bracket fro driving the first shaft, wherein the first belt winds around the first belt pulley and the third belt pulley.

4. The game machine as claimed in claim 3, wherein the driven gear set of the X-axis drive unit comprises a bracket secured on an inner periphery of the lower side of the frame and a second shaft rotatably mounted within the bracket of the driven gear set, a fifth belt pulley securely sleeved on the second shaft, wherein the second belt winds around the second belt pulley and the fifth belt pulley.

5. The game machine as claimed in claim 4, wherein the driven gear set of the X-axis drive unit comprises a sixth belt pulley securely sleeved on the second shaft, the third belt winding around the fourth belt pulley and the sixth belt pulley.

6. The game machine as claimed in claim 2, wherein the Y-axis drive unit comprises a drive gear set mounted on the lower slider and a eighth belt pulley rotatably mounted to an under side of the upper slider, a fourth belt winding around the drive gear set of the Y-axis drive unit and the eighth belt pulley, wherein the fourth belt has a connecting portion secured on the Y-axis slider.

7. The game machine as claimed in claim 6, wherein the drive set of the Y-axis drive unit comprises a bracket mounted on the lower slider and a third shaft rotatably mounted on the bracket of the Y-axis drive unit, a drive set mounted on the bracket of the Y-axis drive unit for driving the third shaft, a seven belt pulley securely sleeved on the third shaft, the fourth belt winding around the seventh belt pulley and the eighth belt pulley.

8. The game machine as claimed in claim 6, wherein drive gear set of the Y-axis drive unit comprises a limit sensor mounted on an upper portion thereof and electrically to the drive set of the Y-axis drive unit, wherein the limit sensor transmits a signal to cut off the power supply of the of the drive set to prevent the Y-axis slider from crashing the drive gear set of the Y-axis drive unit when the limit sensor senses the underside of the Y-axis slider.

9. The game machine as claimed in claim 2, wherein the Z-axis push unit includes a bracket laterally mounted to the Y-axis slider, a fourth shaft rotatably mounted on the bracket of the Z-axis push unit and a drive set mounted on the bracket of the Z-axis push unit for reciprocally driving the fourth shaft, a threaded rod co-axially connected to a second end of the fourth shaft via a clutch, an inner tube stably put around the threaded rod and the inner tube reciprocally moved relative to the threaded rod when the threaded rod is rotated, an outer tube put around the inner tube and secured on the bracket of the Z-axis push unit, wherein the inner tube is movably received in the outer tube, a threaded sleeve co-axially and securely mounted to a rear end of the inner tube, movably received in the outer tube and screwed onto the threaded rod.

10. The game machine as claimed in claim 9, wherein the Z-axis drive unit comprises a head secured on a front end of the inner tube and a pressure sensor mounted in the head.

11. The game machine as claimed in claim 9, wherein the outer tube has a longitudinal groove defined therein and the inner tube has a stub extending therefrom, wherein the stub extends through the longitudinal groove and moved within the longitudinal groove.

12. The game machine as claimed in claim 11, wherein the Z-axis drive unit comprises a front limit sensor and a second limit sensor are respectively secured on two opposite ends of the outer tube and respectively correspond to two opposite ends of the longitudinal groove, the front limit sensor and the rear limit sensor respectively electrically connected to the drive set of the Z-axis push unit for controlling the moving range of the inner tube.

13. The game machine as claimed in claim 9, wherein the rack comprises a panel mounted to a front face for closing the rooms, multiple openings defined in the panel and each opening communicating with a corresponding one of the series of rooms to allow the inner tube with the head extending into the corresponding room.

14. The game machine as claimed in claim 1 further comprising a slot unit disposed on the main frame and electrically connected to the operating unit, the X-axis drive unit, the Y-axis drive unit and the Z-axis push unit for player to input token, coin or bill.

* * * * *

UNITED STATES PATENT AND TRADEMARK OFFICE

CERTIFICATE OF CORRECTION

PATENT NO. : 8,016,292 B1
APPLICATION NO. : 12/891728
DATED : September 13, 2011
INVENTOR(S) : I-Chiang Yang et al.

It is certified that error appears in the above-identified patent and that said Letters Patent is hereby corrected as shown below:

Title page, item [73] assignee: should read as follows:

Feiloli Electronic Co., Ltd., Hemei Town, Changhua County (TW)

Department of Electrical Engineering, National Changhua University of Education, Changhua, (TW)

Signed and Sealed this
Twenty-eighth Day of May, 2013

Teresa Stanek Rea
*Acting Director of the United States Patent and Trademark Office*